US010590509B2

(12) United States Patent
Takahashi

(10) Patent No.: US 10,590,509 B2
(45) Date of Patent: Mar. 17, 2020

(54) METHOD FOR CONTINUOUSLY ANNEALING STEEL STRIP, APPARATUS FOR CONTINUOUSLY ANNEALING STEEL STRIP, METHOD FOR MANUFACTURING HOT-DIP GALVANIZED STEEL STRIP, AND APPARATUS FOR MANUFACTURING HOT-DIP GALVANIZED STEEL STRIP

(71) Applicant: JFE STEEL CORPORATION, Chiyoda-ku, Tokyo (JP)

(72) Inventor: Hideyuki Takahashi, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 14/405,071

(22) PCT Filed: Jun. 10, 2013

(86) PCT No.: PCT/JP2013/003629
§ 371 (c)(1),
(2) Date: Dec. 2, 2014

(87) PCT Pub. No.: WO2013/187039
PCT Pub. Date: Dec. 19, 2013

(65) Prior Publication Data

US 2015/0167113 A1 Jun. 18, 2015

(30) Foreign Application Priority Data

Jun. 13, 2012 (JP) ..... 2012-133615

(51) Int. Cl.
*C23C 2/02* (2006.01)
*C21D 9/56* (2006.01)
(Continued)

(52) U.S. Cl.
CPC ..... *C21D 9/561* (2013.01); *C21D 1/26* (2013.01); *C21D 6/00* (2013.01); *C21D 9/52* (2013.01);
(Continued)

(58) Field of Classification Search
CPC ..... C23C 2/003
See application file for complete search history.

(56) References Cited

U.S. PATENT DOCUMENTS

2003/0091857 A1* 5/2003 Pradhan ..... B32B 15/013 428/659
2009/0123651 A1 5/2009 Okada

FOREIGN PATENT DOCUMENTS

EP 1936000 A1 * 6/2008 ..... C23C 2/02
EP 2653572 A1 10/2013
(Continued)

OTHER PUBLICATIONS

Machine Translation of JP 09324210.*
(Continued)

*Primary Examiner* — David P Turocy
(74) *Attorney, Agent, or Firm* — RatnerPrestia

(57) ABSTRACT

A method for continuously annealing a steel strip includes annealing the steel strip in a vertical annealing furnace, an atmosphere in the furnace being separated by a partition disposed within a space spanning from the heating zone to the soaking zone. An atmosphere gas is supplied from an outside of the furnace into the furnace to form a furnace gas that is discharged from a steel strip entrance at a lower portion of the heating zone, a part of the furnace gas is sucked and discharged into a refiner including a deoxygenator and a dehumidifier such that oxygen and moisture in the part of the furnace gas are removed to form a gas having a lowered dew point, and the gas having a lowered dew point
(Continued)

is returned into the furnace. The method further includes controlling a temperature of the steel strip passing through the partition to a range of 550° C. to 700° C.

13 Claims, 2 Drawing Sheets

(51) Int. Cl.

| | |
|---|---|
| ***C23C 2/40*** | (2006.01) |
| ***C22C 38/06*** | (2006.01) |
| ***C22C 38/04*** | (2006.01) |
| ***C23C 2/06*** | (2006.01) |
| ***C22C 38/02*** | (2006.01) |
| ***C23C 2/20*** | (2006.01) |
| ***C21D 1/26*** | (2006.01) |
| ***C21D 6/00*** | (2006.01) |
| ***C21D 9/52*** | (2006.01) |
| ***C23C 2/00*** | (2006.01) |

(52) U.S. Cl.
CPC ..... *C22C 38/02* (2013.01); *C22C 38/04* (2013.01); *C22C 38/06* (2013.01); *C23C 2/003* (2013.01); *C23C 2/02* (2013.01); *C23C 2/06* (2013.01); *C23C 2/20* (2013.01); *C23C 2/40* (2013.01)

(56) References Cited

FOREIGN PATENT DOCUMENTS

| | | | | |
|---|---|---|---|---|
| JP | 5677338 | | | 6/1981 |
| JP | 04318121 | | | 11/1992 |
| JP | 08109417 | A | * | 4/1996 |
| JP | 2567130 | | | 12/1996 |
| JP | 2567140 | | | 12/1996 |
| JP | 09324209 | | | 12/1997 |
| JP | 09324210 | | | 12/1997 |
| JP | 09324210 | A | * | 12/1997 |
| JP | 10176225 | | | 6/1998 |
| JP | 10176225 | A | * | 6/1998 |
| JP | 2000290762 | | | 10/2000 |
| JP | 2003129125 | | | 5/2003 |
| JP | 2007146241 | | | 6/2007 |
| JP | 2012072451 | | | 4/2012 |
| WO | 2007043273 | | | 4/2007 |
| WO | WO 2012/081719 | A1 | | 6/2012 |

OTHER PUBLICATIONS

Machine Translation of JP 08109417 A.*
Supplementary European Search report for Application No. EP 13 80 3871 dated May 8, 2015.
International Search Report for International Application No. PCT/JP2013/003629 dated Aug. 27, 2013.
Korean Notice of Allowance for Korean Application No. 1020147035255, dated May 1, 2016, 2 pages.
European Communication for European Application No. 13 803 871.6, dated Jul. 31, 2017, 5 pages.
Japanese Office Action for Japanese Application No. JP2013-543074, dated Feb. 4, 2014, including Concise Statement of Relevance of Office Action, 4 pages.
European Communication for European Application No. 13 803 871.6, dated Oct. 31, 2016, 5 pages.

* cited by examiner

METHOD FOR CONTINUOUSLY ANNEALING STEEL STRIP, APPARATUS FOR CONTINUOUSLY ANNEALING STEEL STRIP, METHOD FOR MANUFACTURING HOT-DIP GALVANIZED STEEL STRIP, AND APPARATUS FOR MANUFACTURING HOT-DIP GALVANIZED STEEL STRIP

CROSS REFERENCE TO RELATED APPLICATIONS

This is the U.S. National Phase application of PCT/JP2013/003629, filed Jun. 10, 2013, which claims priority to Japanese Patent Application No. 2012-133615, filed Jun. 13, 2012, the disclosures of each of these applications being incorporated herein by reference in their entireties for all purposes.

FIELD OF THE INVENTION

The present invention relates to a method for continuously annealing a steel strip, an apparatus for continuously annealing a steel strip, a method for manufacturing a hot-dip galvanized steel strip, and an apparatus for manufacturing a hot-dip galvanized steel strip.

BACKGROUND OF THE INVENTION

In recent years, there has been a growing demand for high-strength steel (high-tensile steel) that can contribute to weight reduction of structures in the fields of automobiles, household electrical appliances, and construction materials. In high-tensile steel techniques, the addition of Si to steel facilitates the manufacture of high-strength steel strips having high stretch flangeability, and the inclusion of Si or Al facilitates the manufacture of steel strips having retained γ and high ductility.

In a high-strength cold-rolled steel strip containing an easily oxidizable element, such as Si or Mn, however, the easily oxidizable element may be enriched on a surface of the steel strip during an annealing process and forms an oxide of the easily oxidizable element, such as Si or Mn, thereby causing poor surface appearance or poor chemical conversion treatability, for example, in phosphating.

In a hot-dip galvanized steel strip containing an easily oxidizable element, such as Si or Mn, the easily oxidizable element may be enriched on a surface of the steel strip during an annealing process and forms an oxide of the easily oxidizable element, such as Si or Mn, thereby impairing platability and forming an ungalvanized surface. The easily oxidizable element also reduces the alloying rate after plating. In particular, a $SiO_2$ oxide film on a surface of a steel strip significantly impairs wettability between the steel strip and a hot dipping metal and retards the diffusion of ferrite and a plating metal in alloying. Thus, Si is particularly likely to impair platability and alloying treatability.

A method for avoiding this problem may be a method for controlling the oxygen potential in an annealing atmosphere.

For example, Patent Literature 1 discloses a method for adjusting the dew point in a later part of a heating zone and a soaking zone to a high dew point of −30° C. or more as a method for increasing the oxygen potential. This method has the advantage that the method produces some effect and it is industrially easy to adjust the dew point to the high dew point. However, the method has the disadvantage that it is not easy to manufacture the type of steel that is unsuitable for operation at a high dew point (for example, Ti-IF steel).

This is because it takes a long time to change the annealing atmosphere from a high dew point to a low dew point. Furthermore, the method produces an oxidizing furnace atmosphere, and incorrect operation results in a pickup defect due to deposition of an oxide on a hearth roll or damage to furnace walls.

Another method may be a low oxygen potential method. However, since Si and Mn are highly oxidizable, it is very difficult to stably form an atmosphere having a low dew point of −40° C. or less in which oxidation of Si and Mn is suppressed in a large continuous annealing furnace in a continuous galvanizing line (CGL) or a continuous annealing line (CAL).

For example, Patent Literatures 2 and 3 disclose a technique for efficiently forming a low-dew-point annealing atmosphere. These techniques are applied to relatively small furnaces of one-path vertical furnaces and do not consider annealing of steel strips containing an easily oxidizable element, such as Si or Mn, in multipath vertical annealing furnaces, such as CGL and CAL.

PATENT LITERATURE

PTL 1: WO 2007/043273
PTL 2: Japan Patent No. 2567140
PTL 3: Japan Patent No. 2567130

SUMMARY OF THE INVENTION

The present invention includes a continuous annealing method and a continuous annealing apparatus for a steel strip containing an easily oxidizable element, such as Si or Mn, that can form a low-dew-point annealing atmosphere suitable for annealing of the steel strip at low cost with rare occurrence of pickup defects, little damage to furnace walls, and little formation of an oxide of the easily oxidizable element, such as Si or Mn, resulting from the enrichment of the easily oxidizable element, such as Si or Mn, in steel on a surface of the steel strip.

The present invention also includes a method for manufacturing a hot-dip galvanized steel strip that includes hot-dip galvanizing after annealing of a steel strip using the continuous annealing method. The present invention also provides an apparatus for manufacturing a hot-dip galvanized steel strip that includes the continuous annealing apparatus.

In order to efficiently lower the dew point in a large annealing furnace, the moisture source must be identified. As a result of extensive studies, the present inventor found that the treatment of moisture produced during the reduction of a natural oxidation film of a steel strip is very important. As a result of further studies, the present inventor found the following i) and ii) and completed the present invention.

i) The reduction temperature ranges from 500° C. to 600° C.

ii) Oxidation of an easily oxidizable element, such as Si or Mn, and surface enrichment (a factor impairing platability, such as an ungalvanized surface) occur at a temperature of 700° C. or more.

The following aspects illustrate the measures of the present invention to solve the problems described above.

(1) A method for continuously annealing a steel strip, which includes:

annealing the steel strip in a vertical annealing furnace including a heating zone and a soaking zone through which the steel strip is vertically conveyed, an atmosphere in the furnace being separated by a partition disposed within a space spanning from the heating zone to the soaking zone.

An atmosphere gas is supplied from an outside of the furnace into the furnace to form a furnace gas that is discharged from a steel strip entrance at a lower portion of the heating zone. A part of the furnace gas is sucked and discharged into a refiner, which is disposed outside of the furnace, including a deoxygenator and a dehumidifier such that oxygen and moisture in the part of the furnace gas are removed to form a gas having a lowered dew point. The gas having the lowered dew point is returned into the furnace.

The method further include controlling a temperature of the steel strip passing through the partition to a range of 550° C. to 700° C.

(2) An apparatus for continuously annealing a steel strip, which includes:

a vertical annealing furnace that includes:

a heating zone and a soaking zone through which the steel strip is vertically conveyed; and a partition that is disposed within a space spanning from the heating zone to the soaking zone and separates an atmosphere in the furnace.

An atmosphere gas is supplied from an outside of the furnace into the furnace to form a furnace gas and is discharged from a steel strip entrance at a lower portion of the heating zone. A part of the furnace gas is sucked and discharged into a refiner, which is disposed outside of the furnace, including a deoxygenator and a dehumidifier such that oxygen and moisture in the part of the furnace gas are removed to form a gas having a lowered dew point. The gas having the lowered dew point is returned into the furnace.

The partition is disposed such that the steel strip passing through the partition has a temperature in a range of 550° C. to 700° C.

(3) A method for manufacturing a hot-dip galvanized steel strip, which includes hot-dip galvanizing after the annealing of the steel strip using the continuous annealing method according to (1).

(4) An apparatus for manufacturing a hot-dip galvanized steel strip, which includes a hot-dip galvanizing apparatus disposed downstream of the continuous annealing apparatus according to (2).

The present invention can form a low-dew-point annealing atmosphere suitable for annealing of a steel strip containing an easily oxidizable element, such as Si or Mn, at low cost by separating an atmosphere in a reduction reaction temperature region from an atmosphere in a surface enrichment temperature region using a partition. The present invention can improve platability in hot-dip galvanizing of a steel strip containing an easily oxidizable element, such as Si or Mn.

DETAILED DESCRIPTION OF EMBODIMENTS OF THE INVENTION

Figure 1:
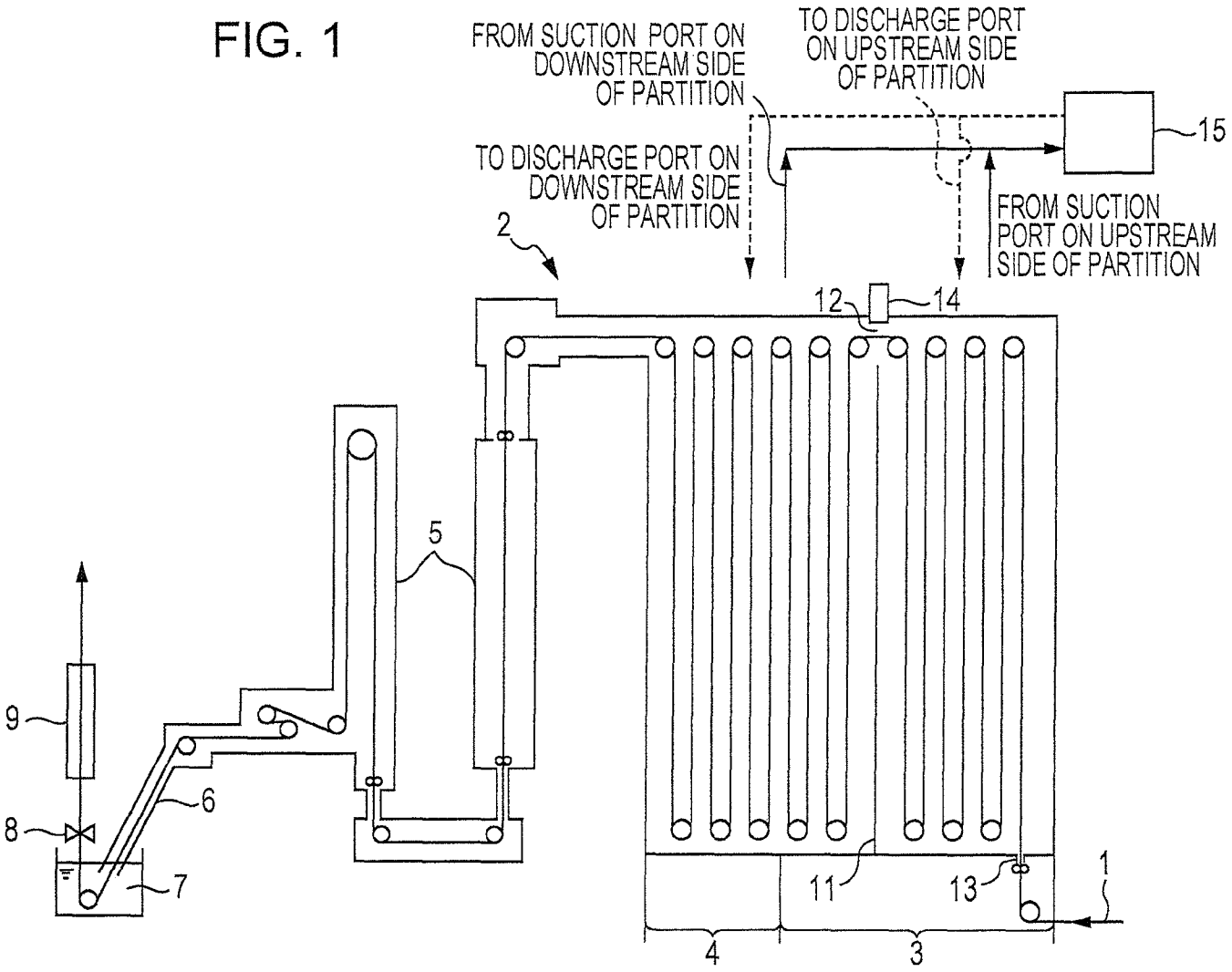
FIG. 1 is a structure example of a continuous galvanizing line for a steel strip that includes a vertical annealing furnace for use in the implementation of the present invention.

In order to efficiently lower the dew point of an annealing furnace in a continuous annealing line for steel strips or a continuous galvanizing line for steel strips, it is very important to identify a moisture source that increases the dew point. The present inventor found, from multipoint continuous dew point measurements in an actual annealing furnace, that a moisture source is present at a steel strip temperature in the range of 500° C. to 600° C. A laboratory experiment showed that the reduction of an oxide film is fastest in this temperature range. Thus, the present inventor recognized that the reduction of a natural oxidation film of a steel strip is largely responsible for the high dew point in this range.

The surface enrichment level of an easily oxidizable element, which greatly affects platability, increases with increasing steel strip temperature. The influence of temperature depends greatly on the type of element in the steel strip. With respect to Mn and Si known as representative examples of elements for use in high-tensile steel, a laboratory experiment showed that the surface enrichment of Mn and Si proceeded in a steel strip temperature range of 800° C. or more and 700° C. or more, respectively.

As described above, the production of water due to the reduction occurs at a temperature in the range of 500° C. to 600° C., and surface enrichment becomes a problem at 700° C. or more in the case of Si and 800° C. or more in the case of Mn. Thus, the present inventor recognized that separation of an atmosphere in a reduction reaction temperature region from an atmosphere in a surface enrichment temperature region is effective in maintaining platability. More specifically, by providing a partition for separating atmospheres and controlling the temperature of a steel strip passing through the partition in the range of 550° C. to 700° C., moisture resulting from the reduction of a natural oxidation film can be mostly trapped in a low-temperature region on the upstream side of the partition, which does not affect platability. Thus, by providing a partition for separating atmospheres and controlling the temperature of a steel strip passing through the partition in the range of 550° C. to 700° C., the dew point in a high-temperature region on the downstream side of the partition, in which surface enrichment of an easily oxidizable element occurs, can be kept low at low cost.

When the temperature of a steel strip passing through a partition for separating atmospheres is more than 700° C., the reduction reaction is completed on the upstream side of the partition (before a separation zone), and surface enrichment adversely affects platability, thus resulting in poor plating quality.

When the temperature of a steel strip passing through a partition for separating atmospheres is less than 550° C., the reduction is not completed in the low-temperature region on the upstream side of the partition and also proceeds in the high-temperature region on the downstream side of the partition. Thus, it is particularly important to lower the dew point of the atmosphere in the high-temperature region.

There are two methods for separating atmospheres: a method for physically separating atmospheres and a method for non-physically separating atmospheres using gas seal, for example. For the design of a new furnace, a physical separation method is suitable. A specific physical separation method may be a wall (partition) formed of refractory bricks. Since this method requires an opening through which a steel strip can travel, the atmosphere cannot be completely separated. In this method, however, the opening in the partition can be as distant as possible from the furnace gas discharge port so as to separate the atmosphere on the upstream side of the partition from the atmosphere on the downstream side of the partition. In an annealing furnace that is provided with a refiner that includes a deoxygenator and a dehumidifier at the outside of the furnace, the dew point of the annealing atmosphere can be lowered at low cost by combining the arrangement of a partition, suction of a gas into the refiner, and discharge of a gas from the refiner.

Figure 2:
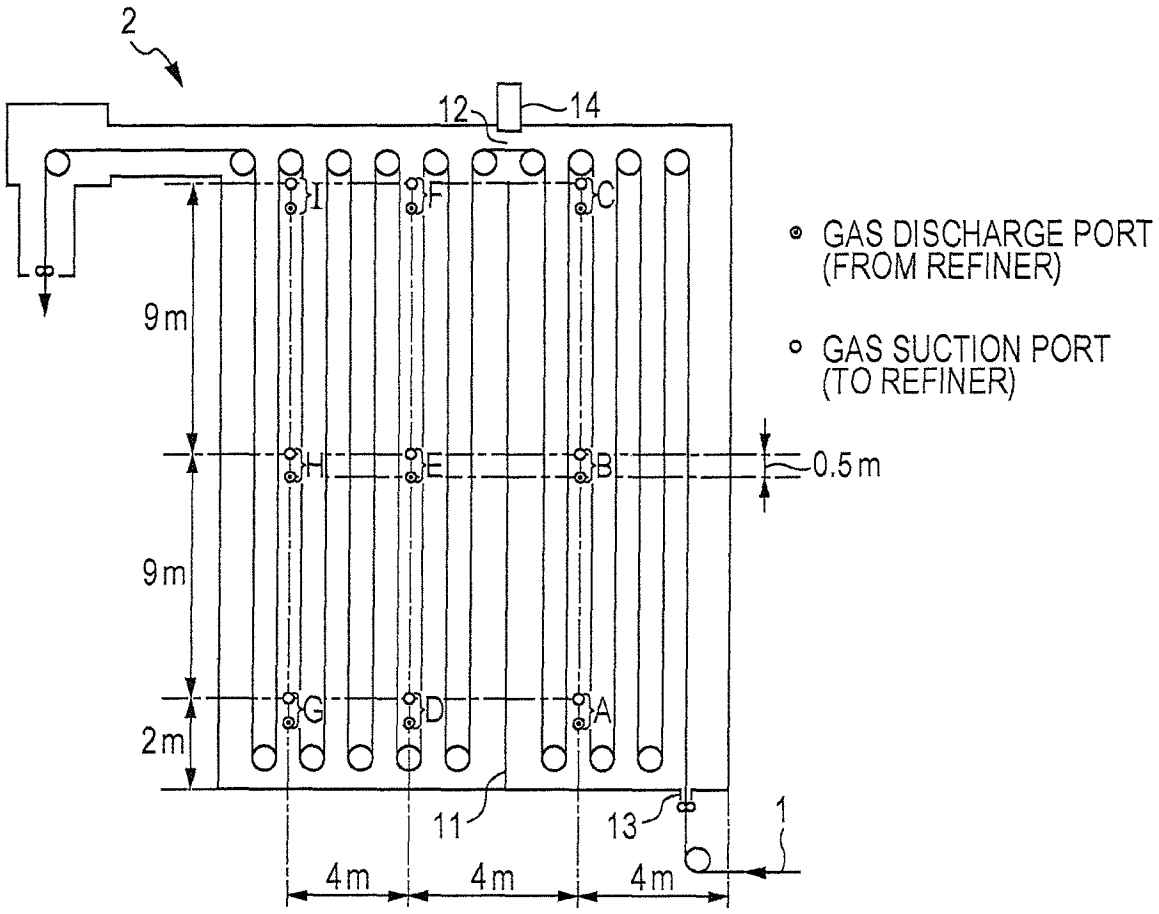
FIG. 2 is an arrangement example of gas suction ports into a refiner and gas discharge ports from the refiner in a heating zone and a soaking zone of an annealing furnace.

FIG. 1 is a structure example of a continuous galvanizing line for a steel strip that includes a vertical annealing furnace for use in the implementation of the present invention. FIG. 2 is an arrangement example of gas suction ports into a refiner and gas discharge ports from the refiner in a heating zone and a soaking zone of an annealing furnace. Embodiments of the present invention will be described below with reference to FIGS. 1 and 2.

The continuous galvanizing line illustrated in FIG. 1 includes a multipath vertical annealing furnace 2 disposed upstream of a plating bath 7. In general, the annealing furnace 2 includes a heating zone 3, a soaking zone 4, and a cooling zone 5 in this order in the downstream direction of the furnace. A partition 11 for separating atmospheres is disposed within a space spanning from the heating zone 3 to the soaking zone 4. The partition 11 is substantially vertically disposed and separates the atmosphere on the upstream side of the partition from the atmosphere on the downstream side of the partition. The partition 11 has an opening 12 through which a steel strip 1 can travel. The opening 12 in the partition 11 is preferably as distant as possible from an opening 13 at the entry side of the furnace for discharging a furnace gas. In the annealing furnace illustrated in FIG. 1, the opening 12 in the partition 11 is disposed in an upper portion of the partition (on the upper side of the furnace), which is farthest from the opening 13 at the entry side of the furnace. If necessary, the separation of the atmospheres at the opening 12 in the partition can be improved using a known non-contact method, such as gas seal.

14 denotes a thermometer for measuring the temperature of a steel strip passing through the opening in the partition.

The annealing furnace 2 is coupled to the plating bath 7 through a snout 6. The furnace extending from the heating zone 3 to the snout 6 is filled with a reducing atmosphere gas or has a non-oxidizing atmosphere. The steel strip 1 is indirectly heated in the heating zone 3 and the soaking zone 4 using a radiant tube (RT) as a heating means.

The reducing atmosphere gas is generally a $H_2$—$N_2$ gas and is introduced into an appropriate portion from the heating zone 3 to the snout 6 of the furnace. The gas introduced into the furnace is discharged from the entry side of the furnace except for the inevitable portion, such as a gas leaking from the furnace body. The furnace gas flows in the direction opposite to the traveling direction of the steel strip or in the upstream direction of the furnace and is discharged from the furnace through the furnace inlet opening 13 at the entry side of the furnace.

In order to lower the dew point of the atmosphere gas in the annealing furnace, a refiner 15 that includes a deoxygenator and a dehumidifier is disposed outside of the furnace. Part of the atmosphere gas in the furnace is sucked and discharged into the refiner 15, in which oxygen and moisture in the gas are removed to lower the dew point. The gas having a lowered dew point is discharged into the furnace. The refiner may be a known refiner.

Gas suction ports into the refiner and gas discharge ports from the refiner are appropriately disposed on the upstream side and the downstream side of the partition 11 disposed within a space spanning from the heating zone to the soaking zone. In FIG. 2, three gas suction ports into the refiner are disposed in the heating zone at different heights in the furnace height direction, and six gas suction ports into the refiner are disposed in the soaking zone at different positions in the furnace length direction and at different heights in the furnace height direction. The furnace length direction is the horizontal direction in FIG. 2. Gas discharge ports from the refiner are disposed 0.5 m below the gas suction ports. The gas suction rate in each of the suction ports and the gas discharge rate in each of the discharge ports can be independently controlled.

In annealing of a steel strip in the annealing furnace, it is very important to control the temperature of the steel strip passing through the partition. As described above, the reduction temperature ranges from 500° C. to 600° C., and the surface enrichment temperature is 700° C. or more in the case of Si and 800° C. or more in the case of Mn. Since the reduction temperature range is close to the surface enrichment temperature range, inappropriate temperature control not only reduces the advantages of the present invention but also may have an adverse effect.

In the present invention, the temperature of a steel strip passing through the partition is preferably controlled in the range of 550° C. to 700° C. When the steel strip temperature is less than 550° C., an insufficiently reduced steel strip is conveyed into the high-temperature region on the downstream side of the partition, and large amounts of gases resulting from the reduction are produced in the high-temperature region. This increases the dew point in the high-temperature region and impairs platability. On the other hand, when the steel strip temperature is more than 700° C., surface enrichment occurs in the low-temperature region having a high dew point on the upstream side of the partition. This impairs platability. The temperature of a steel strip passing through the partition more preferably ranges from 600° C. to 700° C. in which the reduction is almost completed and the effects of surface enrichment are almost negligible. The temperature of a steel strip passing through the partition can be controlled by adjusting heating capability, such as the amount of heat, of RT in a manner that depends on the line speed and the thickness of the steel strip.

In the case where the conditions, such as the line speed and the thickness of a steel strip, are not significantly changed, a portion of the annealing furnace at which the temperature of a steel strip passing through the partition ranges from 550° C. to 700° C. is determined in advance, and the partition may be disposed in the portion.

When the temperature of a steel strip passing through the partition ranges from 550° C. to 700° C., the steel strip containing Si and Mn can have improved platability at a Si content of 0.1 mass % or less even without the refiner. When the steel strip has a Si content of more than 0.1 mass %, the platability cannot be improved without lowering the dew point of the furnace gas with a refiner. A gas may be discharged into the refiner from the low-temperature region on the upstream side of the partition or from the high-temperature region on the downstream side of the partition. When the refiner gas discharge ports are disposed downstream of the partition, discharge of a gas into the refiner is preferably made on the downstream side of the partition and is as distant as possible from the discharge positions, in order to efficiently lower the dew point. The discharge positions from the refiner are not particularly limited. In order to effectively use the discharge gas having a low dew point, a gas from the refiner is preferably discharged into a position as distant as possible from the gas discharge port into the refiner.

Since the reduction is completed at more than 700° C., water is released only on the upstream side of the partition. The effects of surface enrichment are also significant in this temperature range. Thus, the temperature control at the partition is insignificant.

A steel strip passing through the partition is maintained at a high temperature in the soaking zone. The temperature of the steel strip in the soaking zone depends on the quality requirements of the material and may range from approximately 730° C. to 910° C.

A steel strip subjected to predetermined annealing in the heating zone 3 and the soaking zone 4 is cooled in the cooling zone 5, is immersed in the plating bath 7 through the snout 6, and is subjected to hot-dip galvanizing. The amount of plating is adjusted to a predetermined amount of plating using a wiping nozzle 8. Thus, a hot-dip galvanized steel strip is manufactured. Alternatively, after the amount of plating is adjusted using the wiping nozzle 8, the hot-dip galvanized steel strip is subjected to alloying using a heater 9.

In a steel strip annealed using a method according to the present invention, surface enrichment of an easily oxidizable element, such as Si or Mn, can be suppressed, and hot-dip galvanizing can improve platability. The advantages of a method according to the present invention were confirmed with steel strips containing Si: 0.4 to 3.0 mass % and/or Mn: 1 to 3 mass %.

In the annealing furnace described above, a steel strip is introduced into the furnace from a lower portion of the furnace. A steel strip may be introduced into the furnace from an upper side of the furnace. In the annealing furnace described above, a steel strip travels over the partition. A steel strip may travel under the partition. In the annealing furnace described above, the soaking zone is in communication with the cooling zone in an upper portion of the furnace. The soaking zone may be in communication with the cooling zone in a lower portion of the furnace. In the annealing furnace described above, there is no preheating furnace upstream of the heating zone. The annealing furnace may be provided with a preheating furnace.

An annealing method according to the present invention can also be applied to an annealing method and an annealing apparatus in a continuous annealing line (CAL) for steel strips.

Examples

As illustrated in FIGS. 1 and 2, a CGL included an all radiant type (ART) annealing furnace, which included a partition for physically separating the furnace atmosphere disposed within a space spanning from a heating zone to a soaking zone and a refiner that included a dehumidifier and a deoxygenator disposed outside the furnace. While the furnace atmosphere conditions were changed, the dew point was measured. A steel strip was subjected to hot-dip galvanizing to manufacture a hot-dip galvanized steel strip. The platability was evaluated.

The furnace length from the heating zone to the soaking zone (the furnace length in the horizontal direction in FIG. 2) was 16 m. The furnace length of the heating zone was 6 m. The furnace length of the soaking zone was 10 m. The partition was 6 m distant from an entry side furnace wall. Nine portions to which an atmosphere gas was supplied from the outside of the furnace were disposed at each of heights of 1 m and 10 m from the hearth on a drive side in the soaking zone in the longitudinal direction of the furnace (18 in total). The supplied atmosphere gas had a dew point in the range of −60° C. to −70° C. and was a $H_2$—$N_2$ gas ($H_2$ concentration: 10% by volume).

Gas suction ports into the refiner and gas discharge ports from the refiner were illustrated in FIG. 2. The coordinates (the distance from the entry side furnace wall and the distance from the furnace bottom) of atmosphere gas suction ports A to I in FIG. 2 were A=(4 m, 2 m), B=(4 m, 11 m), C=(4 m, 20 m), D=(8 m, 2 m), E=(8 m, 11 m), F=(8 m, 20 m), G=(12 m, 2 m), H=(12 m, 11 m), and I=(12 m, 20 m). Discharge ports A to I were disposed 0.5 m under the corresponding suction ports A to I (Suction/discharge from one furnace wall). The suction ports were ϕ200 mm, and the discharge ports were ϕ50 mm. Synthetic zeolite was used in the dehumidifier in the refiner, and a palladium catalyst was used in the deoxygenator.

Cold-rolled steel strips having a thickness in the range of 0.8 to 1.2 mm and a width in the range of 950 to 1000 mm (of four types A to D in Table 1) were tested at an annealing temperature of 820° C. and at a strip velocity in the range of 100 to 120 mpm under conditions as similar as possible.

TABLE 1

| Type of steel | C | Si | Mn | S | (mass %) Al |
|---|---|---|---|---|---|
| A | 0.12 | 0.1 | 2.3 | 0.003 | 0.03 |
| B | 0.12 | 0.5 | 1.7 | 0.003 | 0.03 |
| C | 0.12 | 1.3 | 2.0 | 0.003 | 0.03 |
| D | 0.12 | 1.9 | 2.8 | 0.003 | 0.03 |

On the basis of the dew point of the atmosphere without the refiner (initial dew point) (−34° C. to −36° C.), the dew point after the refiner was operated for one hour was examined. The dew point was measured at the same positions as the gas suction ports (on the furnace wall side opposite the gas suction ports).

The following are evaluation criteria for platability (plating quality).

Double circle: acceptable (a fine surface and a quality level of an outer plate), Circle: acceptable (a quality level of an inner plate), Triangle: minute defects (ungalvanized etc.), Cross: serious defects (largely ungalvanized), unsatisfactory Tables 2 and 3 show the results.

TABLE 2

| | Dew Point | | | | | | | | | Steel sheet | Fbw rate | | | |
|---|---|---|---|---|---|---|---|---|---|---|---|---|---|---|
| | | | | | | | | | | temperature | Suction | Suction | Suction | Suction |
| No. | A ° C. | B ° C. | C ° C. | D ° C. | E ° C. | F ° C. | G ° C. | H ° C. | I ° C. | at partition ° (C.) | A | B | D Nm³/hr | E |
| 1 | −32.3 | −31.7 | −32.2 | −44.2 | −44.0 | −42.4 | −45.9 | −45.1 | −43.8 | 800 | 0 | 0 | 0 | 0 |
| 2 | −32.8 | −32.6 | −33.2 | −44.1 | −44.0 | −42.2 | −45.7 | −45.0 | −43.8 | 750 | 0 | 0 | 0 | 0 |
| 3 | −33.5 | −34.3 | −34.5 | −44.0 | −43.3 | −42.0 | −45.5 | −44.8 | −43.9 | 700 | 0 | 0 | 0 | 0 |
| 4 | −35.0 | −35.3 | −35.7 | −43.4 | −43.9 | −43.4 | −43.9 | −43.6 | −43.9 | 650 | 0 | 0 | 0 | 0 |
| 5 | −36.1 | −36.3 | −36.4 | −44.0 | −43.3 | −42.0 | −45.5 | −44.8 | −43.9 | 600 | 0 | 0 | 0 | 0 |
| 6 | −37.6 | −38.3 | −38.1 | −40.6 | −39.4 | −38.2 | −41.1 | −40.3 | −39.7 | 550 | 0 | 0 | 0 | 0 |
| 7 | −41.8 | −42.6 | −39.4 | −35.1 | −34.9 | −36.4 | −35.3 | −35.2 | −37.2 | 500 | 0 | 0 | 0 | 0 |

TABLE 2-continued

| | | | | | | | | | | | | | | |
|---|---|---|---|---|---|---|---|---|---|---|---|---|---|---|
| 8 | −42.2 | −43.6 | −41.1 | −32.8 | −33.1 | −35.7 | −33.8 | −34.1 | −34.6 | 450 | 0 | 0 | 0 | 0 |
| 9 | −43.2 | −45.3 | −46.8 | −54.7 | −52.7 | −50.3 | −54.7 | −52.4 | −51.4 | 800 | 400 | 400 | 0 | 0 |
| 10 | −39.4 | −41.2 | −41.3 | −52.1 | −51.2 | −48.3 | −52.1 | −51.1 | −50.4 | 800 | 100 | 0 | 300 | 300 |
| 11 | −43.8 | −45.7 | −47.8 | −54.9 | −52.8 | −50.4 | −55.0 | −52.1 | −51.1 | 750 | 400 | 400 | 0 | 0 |
| 12 | −39.7 | −41.8 | −42.0 | −52.3 | −51.4 | −48.7 | −52.2 | −51.0 | −50.4 | 750 | 100 | 0 | 300 | 300 |
| 13 | −44.7 | −46.3 | −48.7 | −54.4 | −52.1 | −51.0 | −54.8 | −51.9 | −51.0 | 700 | 400 | 400 | 0 | 0 |
| 14 | −40.3 | −42.3 | −42.9 | −52.4 | −51.4 | −48.8 | −52.1 | −51.0 | −50.5 | 700 | 100 | 0 | 300 | 300 |
| 15 | −45.3 | −47.4 | −49.3 | −54.5 | −51.9 | −51.1 | −54.6 | −51.8 | −50.8 | 650 | 400 | 400 | 0 | 0 |
| 16 | −40.9 | −43.1 | −43.5 | −52.3 | −51.5 | −49.0 | −52.0 | −51.2 | −50.6 | 650 | 100 | 0 | 300 | 300 |
| 17 | −46.2 | −48.1 | −50.1 | −54.2 | −52.1 | −51.7 | −54.3 | −52.0 | −51.9 | 600 | 400 | 400 | 0 | 0 |
| 18 | −41.7 | −43.9 | −44.2 | −52.2 | −51.6 | −49.3 | −52.0 | −51.2 | −50.8 | 600 | 100 | 0 | 300 | 300 |
| 19 | −49.1 | −49.7 | −50.5 | −51.2 | −50.2 | −50.4 | −51.6 | −50.7 | −51.0 | 550 | 400 | 400 | 0 | 0 |
| 20 | −45.1 | −47.3 | −48.0 | −51.8 | −51.1 | −50.9 | −51.9 | −51.3 | −51.3 | 550 | 100 | 0 | 300 | 300 |
| 21 | −49.7 | −49.5 | −48.9 | −50.4 | −48.3 | −47.2 | −49.7 | −48.0 | −47.6 | 500 | 400 | 400 | 0 | 0 |
| 22 | −49.0 | −49.0 | −48.6 | −51.7 | −50.8 | −50.6 | −51.9 | −51.0 | −51.0 | 500 | 100 | 0 | 300 | 300 |
| 23 | −49.7 | −49.9 | −49.2 | −49.1 | −47.9 | −46.8 | −49.2 | −47.4 | −46.5 | 450 | 400 | 400 | 0 | 0 |
| 24 | −49.2 | −49.5 | −49.0 | −51.6 | −50.7 | −50.5 | −51.4 | −50.9 | −50.8 | 450 | 100 | 0 | 300 | 300 |

| | Fbw rate | | | | | | | |
|---|---|---|---|---|---|---|---|---|
| No. | Suction F | Suction I | Discharge C | Discharge D | Discharge G | Discharge H | Discharge I | Note |
| | $Nm^3/hr$ | | | | | | | |
| 1 | 0 | 0 | 0 | 0 | 0 | 0 | 0 | Comparative example |
| 2 | 0 | 0 | 0 | 0 | 0 | 0 | 0 | Comparative example |
| 3 | 0 | 0 | 0 | 0 | 0 | 0 | 0 | Comparative example |
| 4 | 0 | 0 | 0 | 0 | 0 | 0 | 0 | Comparative example |
| 5 | 0 | 0 | 0 | 0 | 0 | 0 | 0 | Comparative example |
| 6 | 0 | 0 | 0 | 0 | 0 | 0 | 0 | Comparative example |
| 7 | 0 | 0 | 0 | 0 | 0 | 0 | 0 | Comparative example |
| 8 | 0 | 0 | 0 | 0 | 0 | 0 | 0 | Comparative example |
| 9 | 100 | 100 | 400 | 300 | 300 | 0 | 0 | Comparative example |
| 10 | 300 | 0 | 100 | 0 | 300 | 300 | 300 | Comparative example |
| 11 | 100 | 100 | 400 | 300 | 300 | 0 | 0 | Comparative example |
| 12 | 300 | 0 | 100 | 0 | 300 | 300 | 300 | Comparative example |
| 13 | 100 | 100 | 400 | 300 | 300 | 0 | 0 | Example |
| 14 | 300 | 0 | 100 | 0 | 300 | 300 | 300 | Example |
| 15 | 100 | 100 | 400 | 300 | 300 | 0 | 0 | Example |
| 16 | 300 | 0 | 100 | 0 | 300 | 300 | 300 | Example |
| 17 | 100 | 100 | 400 | 300 | 300 | 0 | 0 | Example |
| 18 | 300 | 0 | 100 | 0 | 300 | 300 | 300 | Example |
| 19 | 100 | 100 | 400 | 300 | 300 | 0 | 0 | Example |
| 20 | 300 | 0 | 100 | 0 | 300 | 300 | 300 | Example |
| 21 | 100 | 100 | 400 | 300 | 300 | 0 | 0 | Comparative example |
| 22 | 300 | 0 | 100 | 0 | 300 | 300 | 300 | Comparative example |
| 23 | 100 | 100 | 400 | 300 | 300 | 0 | 0 | Comparative example |
| 24 | 300 | 0 | 100 | 0 | 300 | 300 | 300 | Comparative example |

TABLE 3

| | Plating quality | | | | |
|---|---|---|---|---|---|
| No. | Steel type A | Steel type B | Steel type C | Steel type D | Note |
| 1 | X | X | X | X | Comparative example |
| 2 | Δ | X | X | X | Comparative example |
| 3 | ○ | Δ | X | X | Comparative example |
| 4 | ○ | Δ | Δ | X | Comparative example |
| 5 | ○ | Δ | X | X | Comparative example |
| 6 | ○ | Δ | X | X | Comparative example |
| 7 | Δ | X | X | X | Comparative example |
| 8 | X | X | X | X | Comparative example |
| 9 | ○ | X | X | X | Comparative example |
| 10 | X | X | X | X | Comparative example |
| 11 | ◎ | Δ | X | X | Comparative example |
| 12 | ○ | X | X | X | Comparative example |
| 13 | ◎ | ◎ | ○ | ○ | Example |
| 14 | ◎ | ◎ | ○ | ○ | Example |
| 15 | ◎ | ◎ | ◎ | ◎ | Example |
| 16 | ◎ | ◎ | ◎ | ◎ | Example |
| 17 | ◎ | ◎ | ◎ | ◎ | Example |
| 18 | ◎ | ◎ | ◎ | ◎ | Example |
| 19 | ◎ | ◎ | ◎ | ○ | Example |
| 20 | ◎ | ◎ | ◎ | ○ | Example |
| 21 | ◎ | Δ | Δ | Δ | Comparative example |

TABLE 3-continued

| | Plating quality | | | | |
|---|---|---|---|---|---|
| No. | Steel type A | Steel type B | Steel type C | Steel type D | Note |
| 22 | ◎ | Δ | Δ | Δ | Comparative example |
| 23 | ◎ | Δ | X | X | Comparative example |
| 24 | ◎ | Δ | Δ | X | Comparative example |

The examples had a lower dew point than the comparative examples and had improved platability.

The present invention can form a low-dew-point annealing atmosphere suitable for annealing of a steel strip containing an easily oxidizable element, such as Si or Mn, at low cost by separating an atmosphere in a reduction reaction temperature region from an atmosphere in a surface enrichment temperature region using a partition. The present invention can improve platability in hot-dip galvanizing of a steel strip containing an easily oxidizable element, such as Si or Mn.

REFERENCE SIGNS LIST

1 Steel strip
2 Annealing furnace

3 Heating zone
4 Soaking zone
5 Cooling zone
6 Snout
7 Plating bath
8 Wiping nozzle
9 Heater
11 Partition
12 Opening in partition
13 Opening at entry side of furnace
14 Thermometer
15 Refiner

The invention claimed is:

1. A method for manufacturing a hot-dip galvanized steel strip, the method comprising:

annealing the steel strip in a vertical annealing furnace including a heating zone and a soaking zone arranged in this order from an entry side of the furnace through which the steel strip is vertically conveyed, an atmosphere in the furnace being separated by a partition disposed within the heating zone, said partition having an opening through which the steel strip passes, wherein:

an atmosphere gas is supplied from an outside of the furnace into the furnace to form a furnace gas that is discharged from a steel strip entrance at the entry side of the furnace;

a part of the furnace gas is sucked and discharged into a refiner, which is disposed outside of the furnace, including a deoxygenator and a dehumidifier such that oxygen and moisture in the part of the furnace gas are removed to form a refiner gas having a lowered dew point, the annealing furnace including a plurality of gas suction ports positioned on a downstream side of the partition in both the heating zone and the soaking zone of the annealing furnace in order to take in gas from the downstream side of the partition in the annealing furnace and a plurality of gas discharge ports to discharge gas from the refiner, wherein the plurality of gas suction ports are provided at different heights in a furnace height direction or the plurality of gas discharge ports are provided at different heights in the furnace height direction; and the refiner gas having the lowered dew point is returned into the furnace; and controlling a temperature of the steel strip passing through the partition to a range of 550° C. to 700° C. so that a dew point of the atmosphere on the downstream side of the partition in the heating zone and the soaking zone of the furnace is lower than a dew point of the atmosphere on an upstream side of the partition and so that the dew point of the atmosphere on the downstream side of the partition in the heating zone and the soaking zone of the furnace is −48.8° C. or less and −54.8° C. or more at the gas suction ports;

wherein the opening in the partition is disposed in an upper portion thereof at a location as distant as possible from the steel strip entrance, and wherein a gas seal is provided at the opening in the partition to separate the atmosphere in the furnace on either side of the partition.

2. The method according to claim 1, further comprising hot-dip galvanizing the steel strip after the annealing.

3. The method according to claim 1, wherein the steel strip is heated to 730° C. to 910° C. in the soaking zone.

4. The method according to claim 3, wherein the atmosphere gas is supplied into the soaking zone of the furnace and the refiner gas is returned into the soaking zone of the furnace.

5. The method according to claim 1, wherein the atmosphere gas is supplied into the soaking zone of the furnace and the refiner gas is returned into the soaking zone of the furnace.

6. The method according to claim 1, wherein the steel strip entrance is at a lower portion of the heating zone.

7. The method according to claim 1, wherein the atmosphere gas supplied from the outside of the furnace into the furnace has a dew point in the range of −60° C. to −70° C.

8. The method according to claim 1, further comprising measuring with a thermometer a temperature of the steel strip while the steel strip is passing through the partition.

9. A method for manufacturing a hot-dip galvanized steel strip, the method comprising:

annealing the steel strip in a vertical annealing furnace including a heating zone and a soaking zone arranged in this order from an entry side of the furnace through which the steel strip is vertically conveyed, an atmosphere in the furnace being separated by a partition disposed within the heating zone, said partition having an opening through which the steel strip passes, a gas seal being provided at the opening in the partition to separate the atmosphere in the furnace on either side of the partition, wherein:

an atmosphere gas is supplied from an outside of the furnace into the furnace to form a furnace gas that is discharged from a steel strip entrance at the entry side of the furnace;

a part of the furnace gas is sucked and discharged into a refiner, which is disposed outside of the furnace, including a deoxygenator and a dehumidifier such that oxygen and moisture in the part of the furnace gas are removed to form a refiner gas having a lowered dew point, the annealing furnace including a plurality of gas suction ports positioned on downstream and upstream sides of the partition in both the heating zone and the soaking zone of the annealing furnace in order to take in gas from the downstream and upstream sides of the partition in the annealing furnace and a plurality of gas discharge ports disposed on the downstream and upstream sides of the partition to discharge gas from the refiner, wherein the plurality of gas suction ports are provided at different heights in a furnace height direction or the plurality of gas discharge ports are provided at different heights in the furnace height direction; and the refiner gas having the lowered dew point is returned into the furnace via the plurality of gas discharge ports; and controlling a temperature of the steel strip passing through the partition to a range of 550° C. to 700° C. so that a dew point of the atmosphere on the downstream side of the partition in the heating zone and the soaking zone of the furnace is lower than a dew point of the atmosphere on an upstream side of the partition and so that the dew point of the atmosphere on the downstream side of the partition in the heating zone and the soaking zone of the furnace is −48.8° C. or less and −54.8° C. or more at the gas suction ports.

10. The method according to claim 9, wherein the opening in the partition is disposed in an upper portion thereof at a location as distant as possible from the steel strip entrance.

11. The method according to claim 10, wherein the steel strip entrance is at a lower portion of the heating zone.

12. The method according to claim 9, wherein the steel strip entrance is at a lower portion of the heating zone.

13. A method for manufacturing a hot-dip galvanized steel strip, the method comprising:

annealing the steel strip in a vertical annealing furnace including a heating zone and a soaking zone arranged in this order from an entry side of the furnace through which the steel strip is vertically conveyed, an atmosphere in the furnace being separated by a partition disposed within the heating zone, wherein:

an atmosphere gas is supplied from an outside of the furnace into the furnace to form a furnace gas that is discharged from a steel strip entrance at the entry side of the furnace;

a part of the furnace gas is sucked and discharged into a refiner, which is disposed outside of the furnace, including a deoxygenator and a dehumidifier such that oxygen and moisture in the part of the furnace gas are removed to form a refiner gas having a lowered dew point; and the refiner gas having the lowered dew point is returned into the furnace; and controlling a temperature of the steel strip passing through the partition to a range of 550° C. to 700° C. so that a dew point of the atmosphere on the downstream side of the partition in the heating zone and the soaking zone of the furnace is lower than a dew point of the atmosphere on an upstream side of the partition and so that the dew point of the atmosphere on the downstream side of the partition in the heating zone and the soaking zone of the furnace is −48.8° C. or less and −54.8° C. or more at gas suction ports positioned on the downstream side of the partition in both the heating zone and the soaking zone of the annealing furnace.

* * * * *